United States Patent [19]

Howard et al.

[11] 4,205,725

[45] Jun. 3, 1980

[54] METHOD FOR FORMING AN AUTOMATIC BURNER FOR IN SITU COMBUSTION FOR ENHANCED THERMAL RECOVERY OF HYDROCARBONS FROM A WELL

[75] Inventors: Curtis E. Howard, Humble; Douglas G. Calvin; Robert W. Pitts, Jr., both of Houston, all of Tex.

[73] Assignee: Texaco Inc., White Plains, N.Y.

[21] Appl. No.: 959,539

[22] Filed: Nov. 13, 1978

Related U.S. Application Data

[60] Division of Ser. No. 837,052, Sep. 28, 1977, Pat. No. 4,137,968, which is a continuation-in-part of Ser. No. 669,127, Mar. 22, 1976, Pat. No. 4,079,784.

[51] Int. Cl.[2] ..... E21B 43/24

[52] U.S. Cl. ..... 166/315; 166/53; 166/59; 166/64; 166/251

[58] Field of Search ..... 166/53, 59, 251, 64, 166/66, 302, 256, 65 R, 315

[56] References Cited

U.S. PATENT DOCUMENTS

| | | | |
|---|---|---|---|
| 2,506,853 | 5/1950 | Berg et al. | 166/59 |
| 3,109,482 | 11/1963 | O'Brien | 166/59 X |
| 3,216,498 | 11/1965 | Palm | 166/59 X |
| 3,298,439 | 1/1967 | Rees, Jr. | 166/59 |
| 3,982,591 | 9/1976 | Hamrick et al. | 166/53 X |
| 4,079,784 | 3/1978 | Howard et al. | 166/59 |

*Primary Examiner*—Stephen J. Novosad
*Attorney, Agent, or Firm*—Carl G. Ries; Thomas H. Whaley; Theron H. Nichols

[57] ABSTRACT

A method for assembling an ignition system for in situ combustion operation to recover petroleum from a well in a subterranean reservoir, and an ignition system for an elongated combustion chamber suspended from a hollow electrical cable and which cable supplies both electrical means and fuel gas to the chamber. Air inlet ducts in the walls of the air inlet cylinder receive air from the annular space between the hollow cable and the wellbore tubing. An electrical ignitor is temporarily energized automatically or responsive to a thermocouple detecting no burning in the combustion chamber to ignite the fuel-air mixture in the combustion chamber. The ignitor is responsive to the thermocouple detecting burning in the combustion chamber for extinguishing the ignitor. The thermocouple is thus responsive to a flameout for re-energizing the ignitor either manually or automatically such that burner operation is interrupted only momentarily.

This new method includes further the steps of electrically connecting a second thermocouple to a limit set means and forming it responsive to the thermocouple for causing the flow of additional secondary air to be automatically increased to cool the electronics portion of the burner if the temperature therein goes beyond safe limits.

8 Claims, 5 Drawing Figures

51
11
13
10
17
50
15
52
33
33
28
19
21a
21b
31
12
18
14
24
22
30
53
FORMATION INTERVAL WHERE-IN IN SITU COMBUSTION IS INITIATED

METHOD FOR FORMING AN AUTOMATIC BURNER FOR IN SITU COMBUSTION FOR ENHANCED THERMAL RECOVERY OF HYDROCARBONS FROM A WELL

BACKGROUND OF THE INVENTION

This is a division of application Ser. No. 837,052, filed Sept. 28, 1977 now U.S. Pat. No. 4,137,968, which is a Continuation-In-Part of our prior application Ser. No. 669,127, filed Mar. 22, 1976, now U.S. Pat. No. 4,079,784.

Great improvements in oil recovery are necessary to satisfy the present and future energy requirements of the United States. Thus, improvements are needed in the field of enhanced thermal recovery, such as an improved in situ combustion ignition system for use in heavy oils, tar sands, and oil shale, particularly in deep wells.

Various types of ignition systems have been used and are in use for in situ combustion ignition. Electrical heaters have been used extensively but are limited to 3000 ft or less due to the problem of supplying adequate electrical power to greater depths. The use of gas burning ignition systems becomes more difficult with depth because most designs include a multiplicity of air and gas conduits and electrical cables which complexes the placement of the systems as the depth becomes greater. A recently developed catalytic heater utilizes only a wireline for placement, but has the disadvantage of operating without a temperature monitoring system. Some gas ignition systems have the disadvantage of requiring complete removal from the well and re-running if flameout occurs. This becomes very expensive in rig time alone.

OBJECTS OF THE INVENTION

It is therefore a primary object of this invention to present an ignition system which alleviates these disadvantages and provides an elaborate control system not heretofore practiced in the art.

Another primary object of this invention is to provide a method for assembling a downhole burner for an in situ combustion operation to recover petroleum from a well in a subterranean reservoir including particularly the step of interconnecting power means with both an ignitor in the burner and the thermocouple adjacent thereto for automatically energizing the ignitor for igniting the air-fuel combustion mixture in the burner when no combustion is occurring and for automatically de-energizing the ignitor when combustion is occurring in the burner for forming a reliable flame-out proof burner.

Accordingly another primary object of this invention is to provide ignition system in a burner for initiating in situ combustion to recover petroleum from a hydrocarbon containing subterranean reservoir in which an air-fuel mixture in the burner having an ignitor and a thermocouple adjacent thereto is ignited when the thermocouple indicates no combustion and the ignitor is extinguished when the thermocouple indicates burning in a combustion chamber to provide a reliable and flame-out proof burner for in situ combustion deep in the well.

A further object of this invention is to provide a downhole automatic burner for an in situ combustion operation deep in a well that is easy to operate, is of simple configuration, is economical to build and assemble, and is of greater efficiency for the recovery of petroleum from the well in a subterranean reservoir.

Other objects and various advantages of the disclosed method for assembling a downhole burner and a new burner for heating or for in situ combustion to recover petroleum will be apparent from the following detailed description, together with the accompanying drawings, submitted for purposes of illustration only and not intended to define the scope of the invention, reference being had for that purpose to the subjoined claims.

BRIEF DESCRIPTION OF THE INVENTION

The drawings diagrammatically illustrate by way of example, not by way of limitation, one form of the invention.

Figure 1:
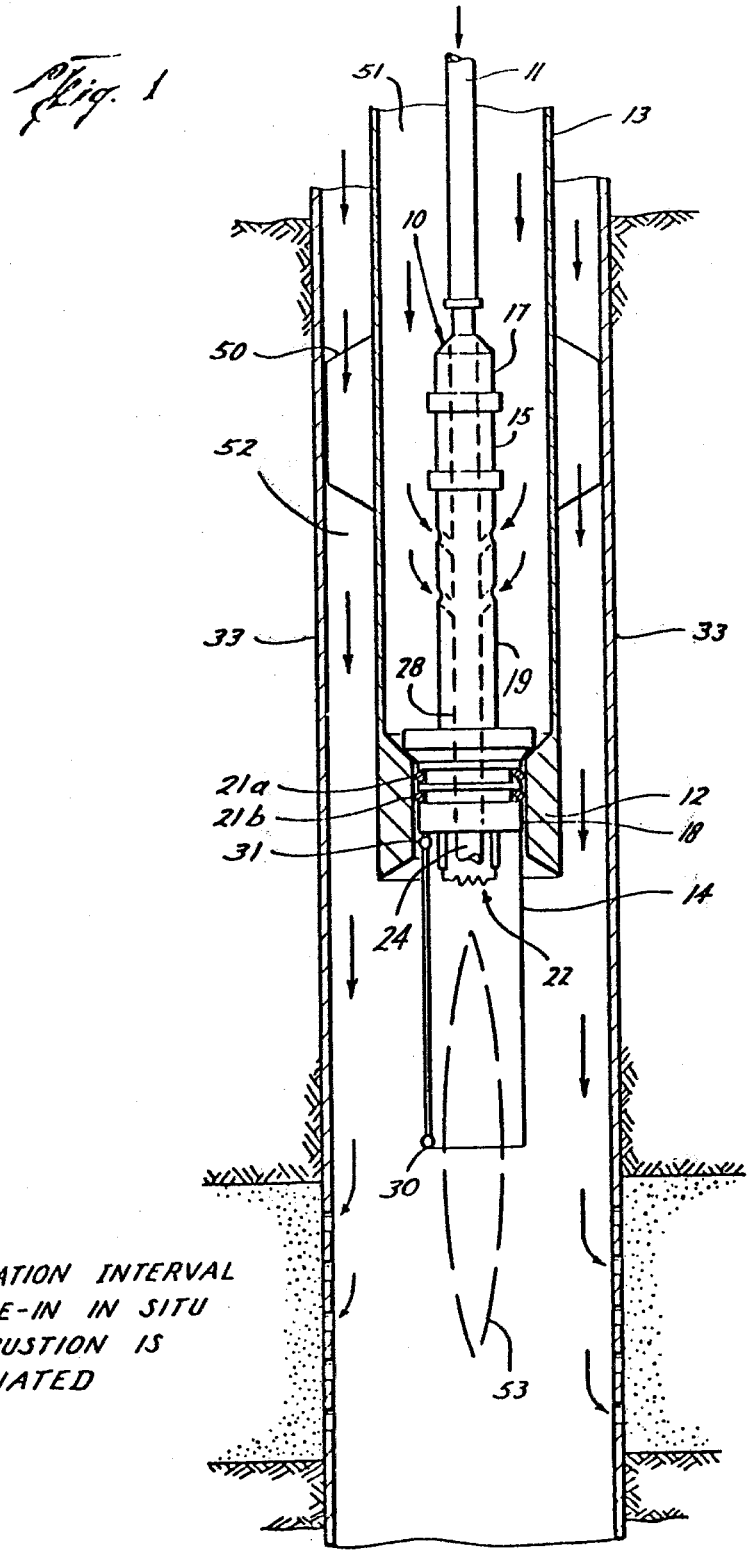
FIG. 1 is a schematic sectional view of the downhole burner for an in situ combustion operation to recover petroleum from a well in a subterranean reservoir for illustrating a burner assemblied by the new method.

The invention disclosed herein, the scope of which being defined in the appended claims, is not limited in its application to the details of construction and arrangement of parts shown and described for carrying out the disclosed method, since the invention is capable of other embodiments for being assemblied by other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE INVENTION

This invention comprises a method for assembling a downhole burner for an in situ combustion operation to recover petroleum from a well in a subterranean reservoir, and a mechanism assembled by the method and for being assembled by the other methods.

METHOD FOR ASSEMBLING AN AUTOMATIC DOWNHOLE BURNER TO RECOVER PETROLEUM

A method for assembling a downhole burner for heating or for an in situ combustion operation to recover petroleum from a well in a subterranean reservoir comprises:

(1) forming an elongated combustion chamber open at both ends, (2) mounting an ignitor in the combustion chamber intermediate the ends thereof, (3) forming orifices in the walls of a thick walled cylinder connected to the upper portion of the combustion chamber, (4) extending a downhole fuel supply conduit through the thick walled cylinder down to the open upper end of the elongated combustion chamber, (5) extending a tubing over the thick walled cylinder and fuel supply conduit and connecting said tubing to the lower portion of said thick walled cylinder for forming a downhole primary air supply annulus for the combustion chamber, (6) forming a secondary air supply annulus between the tubing and the well casing for supplying heat to the reservoir, (7) mounting at least one thermocouple in the upper portion of the combustion chamber for sensing excessive heat in the combustion chamber upper portion, (8) mounting at least one thermocouple in the combustion chamber adjacent the ignitor for detecting whether an air-fuel mixture in the combustion chamber is ignited or not ignited, and (9) interconnecting power means with both the ignitor and the thermocouple for energizing the ignitor for igniting the air-fuel mixture in the combustion chamber when no combustion is occurring and for de-energizing the ignitor when combustion is occurring in the air-fuel combustion chamber for providing a reliable and flame-out proof burner for in situ combustion deep in a well.

The above basic method may likewise include the following additional steps:

(10) passing the electrical conduits through the walls of the thick walled air inlet cylinder and embedding the electrical conduits in the walls of the fuel supply conduit;

(11) forming a plurality of transverse air ducts in the elongated cylindrical thick walled cylinder for forming a downhole air supply annulus around the fuel supply conduit for passage of air from the downhole air supply annulus to the air-fuel combustion chamber for ensuring a highly agitated combustion mixture, and

(12) forming the connection between the downhole air supply annulus and the combustion chamber in a detachable connection for being sealed and unsealed.

A DOWNHOLE BURNER FOR HEATING OR FOR INITIATING IN SITU COMBUSTION TO RECOVER PETROLEUM

A downhole burner is disclosed for being assembled by the above method.

While various devices may be utilized for carrying out or practicing the inventive methods and for being assembled by the above methods, FIGS. 1 and 2 illustrate at least one inventive apparatus for practicing the methods described above.

Figure 2A:
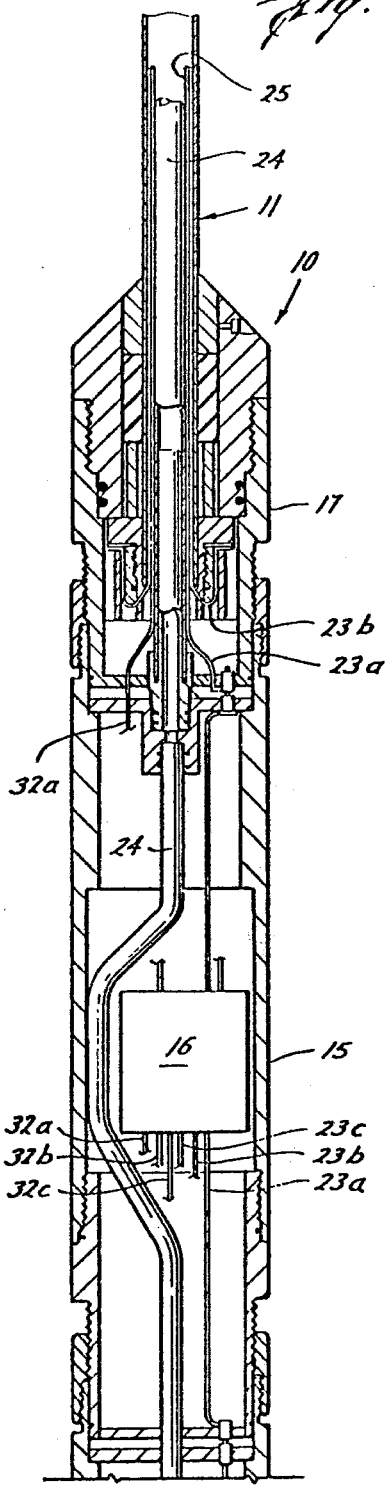
FIG. 2A is a schematic sectional view of the upper portion of the downhole burner.
Figure 2B:
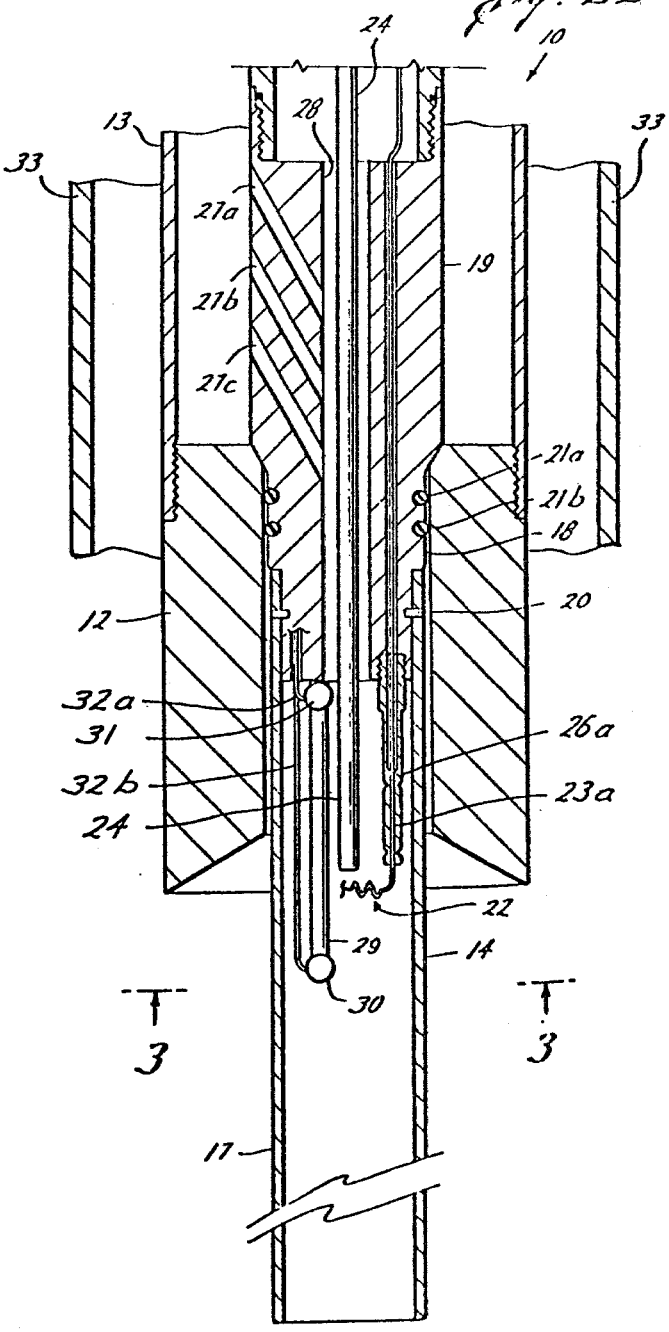
FIG. 2B is a schematic sectional view of the lower portion of the downhole burner.

This gas fired burner 10 is illustrated schematically in FIGS. 1, and in more details in FIGS. 2A and 2B in cross section as being suspended from hollow cable 11, FIGS. 1 and 2A, in the well tubing 13, FIGS. 1 and 2B, the well tubing being centered in and spaced from the well casing 33, with spacers 50, FIG. 1. The gas burner 10 comprises a combustion chamber 14, an air inlet cylinder 19, FIGS. 1 and 2B and an electrical chamber 15, FIGS. 1 and 2A, having an ignitor relay 16, FIG. 2A, and a hollow cable-electrical and natural gas connecting chamber 17, FIGS. 1 and 2A.

Well tubing 13, FIG. 1 is centered in the well casing 33 with the spacers 50, only two spacers or centralizers being shown for clarity of disclosure. A pump seating nipple 12, FIGS. 1 and 2B, is formed on the internal surface of the well tubing 13 for supporting a liquid pump for producing crude oil, as in a reverse or counter-current flow well, for example. After flow of all liquid petroleum has ceased and heat is desired to reduce the viscosity of the remaining petroleum for increased flow for increased production the pump is removed and the gas fired burner 10 lowered into well tubing 13 to rest on the pump seating nipple 12 or the lower end of the air inlet cylinder. Seals are provided between a reduced diameter portion 18, FIGS. 1 and 2B, of the thick walled air inlet cylinder 19, such as, but not limited to, o-rings 21*a*, 21*b*.

Hollow cable 11, FIG. 1, centered in well tubing 13 forms a primay downhole of combustion air supply annulus duct 51. Well tubing 13 centered in well casing 33 forms a secondary air supply annulus duct 52 in which air is pumped down from the surface in annulus 52 for being heated by the flame 53. Hollow cable 11 per se forms the fuel natural gas supply duct, a fuel supply duct 24 illustrated in FIGS. 2A and 2B being deleted in FIG. 1 for clarity of disclosure.

Figures 3, 4:
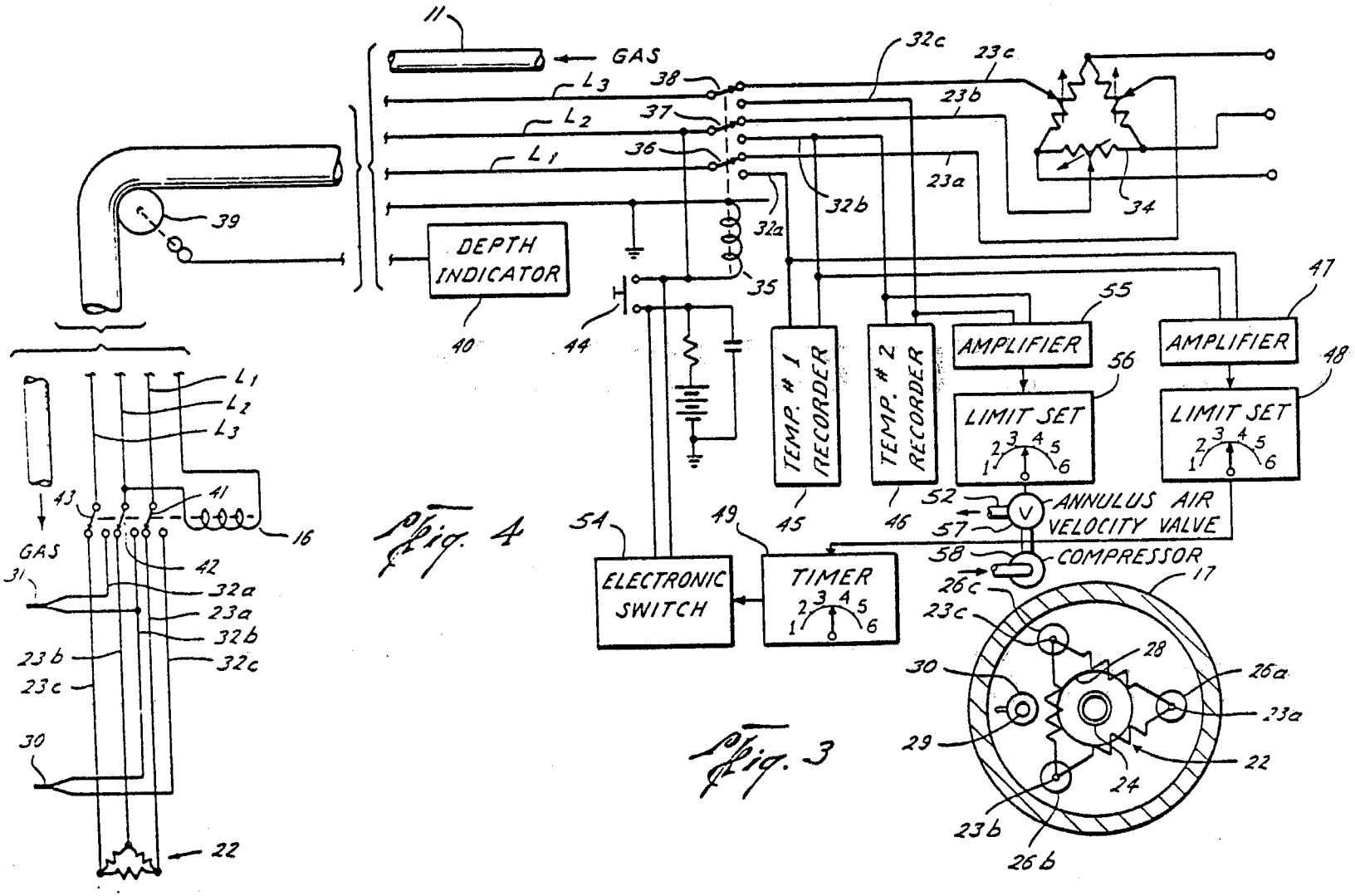
FIG. 3 is a section taken at 3—3 of FIG. 2B.
FIG. 4 is a schematic block diagram of the electronics required to ignite and monitor the in situ combustion.

FIGS. 2A and 2B, enlarged vertical sectional schematic views of the burner 10, provide more details thereof. The combustion chamber 14, FIG. 2B, comprises a hollow, open-ended cylinder sheath (such as a ceramic sheath) with one end fitted over the reduced diameter portion 18 of a thick walled air inlet cylinder 19 and secured thereto with pins 20, or the like. The reduced diameter portion 18 fits down inside the pump seating nipple until the burner comes to rest on the beveled portion where the diameter of the thick walled air inlet cylinder 19 increases to full size. An ignitor 22 shown schematically in FIG. 1, actually comprises three nicrome wire heater elements connected in delta as illustrated in FIGS. 3 and 4. Connected to the three intersections of each of the three elements of the ignitor are wires 23*a*, 23*b* and 23*c*, each wire being in an electrical insulator 26*a*, 26*b* and 26*c*, respectively, FIG. 3. All three insulators and their respective wires are mounted in the end of the cylinder reduced diameter portion 18, FIG. 2B, which extends internally of the combustion chamber ceramic sheath 14. The wires 23*a*, 23*b* and 23*c*, pass up through the thick walled cylinder, through the relay 16, FIG. 2A in the electrical chamber 15, through the hollow cable-electrical and natural gas connecting chamber 17, and into the walls of the insulated wire sheathed hollow cable 11 as electrical wires 25 to the surface where they are connected to the burner ignitor control system disclosed hereinafter. The hollow cable 11 is a reelable armored type hose having an armor-wire outer covering, a coiled-spring inner wall stiffener, and at least three separately insulated electrical conductors embedded between two layers of impervious plastic material forming the walls of the hose, such as, but not limited to assignee's U.S. Pat. No. 3,800,870. This hose or cable is capable of withstanding high pressure, particularly in its use of supplying natural gas, or the like, from the surface down to the combustion chamber. Thus the cable carries the necessary electrical wiring for the ignitor and the thermocouples.

Natural gas is supplied directly to the combustion chamber 14, FIGS. 1 and 2B, at the location of the ignitor heater 22 from the gas supply tube or fuel supply conduit 24, FIG. 2B, which extends down through the burner 10 and the hollow cable 11 from a suitable supply (not shown) at the surface.

Primary air for the gas fired burner 10, FIGS. 1 and 2B is pumped down in the primary air annulus or primary air supply conduit 51 formed between the well tubing or air supply tube 13 and the hollow cable 11. As this pressurized air, arrives at the top of the thick walled air inlet cylinder 19, it passes through transverse and downwardly sloping orifices or air inlet ports 27*a*, 27*b* and 27c, FIG. 2B, to a large axial cylindrical duct 28 in the air inlet cylinder 19. This duct 28 has the fuel supply tube 24, FIG. 2B, mounted in the center thereof as it traverses the full length of the air inlet cylinder 19 from which the fuel supply length of the air inlet cylinder 19 from which the fuel supply tube protrudes a substantial distance to eject the natural gas into the ignitor heater 22. The air from the inlet ports 27a, 27b and 27c, FIG. 2B, empties into the duct 28 or annulus formed therein by the centered fuel supply conduit 24. The pressurized air from these ports if forced down the annulus and, expands into combustion chamber 14 while mixing with the natural gas at ignitor heater 22, FIGS. 1 and 2B, thereby providing a combustible mixture.

A thermocouple support tube 29, FIG. 2B, extends downwardly from the lower end of the air inlet cylinder 19 close to and past the ignitor heater 22. One thermocouple 30 is mounted on thermocouple support tube 29 below the ignitor heater 22 at the end of the support tube and a second thermocouple 31 is mounted on the thermocouple support tube at the base of the tube adjacent the air inlet cylinder 19. Wires 32a, 32b and 32c, FIG. 4, from the two thermocouples 30 and 31 pass up to the relay 16 of the burner 10. From the relay 16, wires $L_1$, $L_2$ and $L_3$ extend to control relay 35 at the surface.

FIG. 3 is a sectional view at 3—3 on FIG. 2B illustrating the ignitor heater 22 and thermocouple 30 mounted on thermocouple support tube 29 in the combustion chamber ceramic sheath 17.

FIG. 4 illustrates schematically the electrical system for the burner ignition system. Three conductors in the wall of the hollow cable provide current for ignition of the burner followed by temperature monitoring of the burner after ignition has been sustained.

More specifically, a three phase electrical power source 34, FIG. 4, having 3 output leads 23a, 23b and 23c supplies 208 volt ac 3-phrase current, for example, to the three wires $L_1$, $L_2$ and $L_3$ respectively in the walls of the hollow gas supply cable 11 through relay 35 having three, 3 pole, double throw, latching switches 36, 37 and 38.

Relays 16 and 35, FIG. 4, are current pulse activated step relays, such as but not limited to, the series 50 manufactured by Ledex Inc. of Dayton, Ohio 45402. Capacitor c is discharged through the relay coils when push button switch 44 is pressed. Latching switches 36, 37 and 38 of step relay 35 switches electrical lines $L_1$, $L_2$ and $L_3$ between the heater wires 23a, 23b and 23c, respectively, and the recorder wires 32a, 32b and 32c, respectively. Cable 11 is lowered over pulley 39, for example, into the well to the desired depth as indicated by the depth indicator 40 and the pump seating nipple 12, FIG. 2B. Relay 35 FIG. 4, is connected in parallel with relay 16. Relay 16 down in the burner likewise is illustrated on FIG. 4 a having latching switches 41, 42 and 43, for connecting wires $L_1$, $L_2$ and $L_3$ respectively, to either the nicrome wire heater 22 through wires 23a, 23b and 23 c or to the two thermocouples 30 and 31 through wires 32a, 32b and 32c. Recorders 45 and 46 show instant readouts of the temperatures encountered in the burner 10. Manual push button switch 44 thus may connect the electrical power 34 to the ignitor heater 22 with the relays 16 and 35 set as illustrated in FIG. 4, or it may connect the recorders 45, 46 to the thermocouples 30 and 31, by actuation of the relays to their other position. Thermocouple 30 detects the temperature of the flame below the ignitor while thermocouple 31 detects the temperature of the upper portion of the rest of the ignitor sensitive to excessive heat. This manual operation is disclosed in greater detail in our copending patent application Ser. No. 669,127, filed Mar. 22, 1976 now U.S. Pat. No. 4,079,784, issued Mar. 21, 1978.

Briefly, in manual operation, for introducing heat to the formation in order to reduce the viscosity of the petroleum so that it will flow more readily for recovery, the burner 10 is lowered down into the well to rest on the pump seating nipple 12, FIG. 2B, and to be sealed therein by o-rings 21a, 21b. Natural gas is pumped down at a predetermined pressure through the hollow cable 11 to the combustion chamber 14 while the precise amount of primary air is pumped down the annulus around the hollow cable to inside the combustion chamber to provide an explosive mixture therein. Power source 34, FIG. 4, also at the surface, is then actuated with the manual push button switch 44 (not shown actuated yet) and relays 35 and 16 set as illustrated in FIG. 4, to activate the heater ignitor wire coil element 22 for a few seconds to ignite the combustion mixture in the combustion chamber 14, FIG. 2B, deep in the well. After a sufficient time period has lapsed to ensure ignition of the burner 10, push button switch 44 is released to the position illustrated in FIG. 4. Instantly relays 35 and 16 flip their respective three switches to the other position from that illustrated on FIG. 4 to thereby disconnect the power source 34 from the ignitor 22 and to interconnect the temperature recorders 45 and 46 with their respective thermocouples 30 and 31.

After the heater is lighted deep in the well, additional air is required to heat the formation or reservoir. This additional air is pumped down from the surface in larger annulus or secondary air supply conduit annulus 52, FIG. 1 formed between the well tubing 13 and the well casing 33. As this air passes down and around the full length of the heater 14 and a portion of the flame, it becomes very hot. This heated air is then transferred to the formation interval, as illustrated on FIG. 1, and in due course with continued burning, in situ combustion results and is contained for as long as desired.

Recorder 45 would then be indicating the temperature of combustion in the combustion chamber and recorder 46 would be indicating the temperature at which the upper portion of the burner is being exposed to, as the vulnerable electronic equipment therein. When the combustion chamber temperature drops below combustion temperature, a flame-out is indicated immediately and after it is determined that the gas and air supplies are adequate, then the switch 44, FIG. 4, is manually actuated or pushed to flip both relays 35 and 16 and their respective 3 switches each to disconnect the recorders 45 and 46 from the thermocouples 30, 31 and to interconnect the power source 34 with the ignitor 22 to relight the burner. After adequate time has lapsed for ignition, push-button switch 44 releases.

Automatic operation of the ignitor 22 occurs as follows. Amplifier 47, FIG. 4, sends a signal to limit set 48. This electronics samples the signals from thermocouple 30. If the signal indicates that the fire is out or the temperature is less than set, a signal will go to the time module 49. The output signal from the timer module 49 will send a signal to the electronic switch 34. The signal sent from timer 49 will exist and the ignitor 22 energized for a suitable period of time, then revert back to a sample mode and remain until smaller temperature sample can be taken. If at that time the heat has not risen to within limits set on timer 48, timer 49 will repeat its cycle.

The electronic switch 54, FIG. 4 electronically by-passes the manual push button switch 44. If too high a temperature is recorded on recorder 46 from thermocouple 31 indicating the electrical portion of the burner may be approaching a too high or critical temperature, the air velocity in secondary air annulus 51, FIGS. 1 and 4 may be automatically increased for cooling of the burner.

This increase in secondary air flow is accomplished by Amplifier 55, FIG. 4, transmitting signals from temperature Recorder 2, or 46 to limit set 56. A temperature that is above the set limit is detected and annulus control valve 57 causes compressor 58 to force more air down secondary air annulus 52, FIGS. 1 and 4.

As an improved modification, automatic operation as also illustrated in FIG. 4 is obtained by the manual switch 44 being by-passed by electronic switch 54 which is responsive to a predetermined low temperature in thermocouple 30 for switching power to the ignitor burner for a predetermined period of time as explained in greater detail hereinbefore. Similarly secondary air and fuel is automatically increased for cooling when thermocouple 31, FIGS. 2B and 4, senses too high a temperature.

Obviously other methods may be utilized for heating and for initiating in situ combustion and other embodiments than that of FIGS. 1 and 4 may be utilized, depending on the particular subsurface lithology or petrography at the various depths.

Accordingly, it will be seen that the production of hydrocarbons from a subterranean hydrocarbon-bearing formation is stimulated by the burner formed by the above method and by the above downhole burner, and the disclosed burner will operate in a manner which meets each of the objects set forth hereinbefore.

While only one basic method of the invention and one mechanism formed thereby have been disclosed, it will be evident that various other methods and modifications are possible in the arrangement and construction of the disclosed methods and systems without departing from the scope of the invention and it is accordingly desired to comprehend within the purview of this invention such modifications as may be considered to fall within the scope of the appended claims.

We claim:

1. A method for assembling an automatic downhole burner for an in situ combustion operation in a well in a subterranean reservoir for recovering petroleum from the well comprising, (a) forming an elongated combustion chamber means open at both ends, (b) mounting an ignitor in the combustion chamber means intermediate the ends thereof, (c) forming orifices in the walls of an air inlet cylinder connected to the upper end of the combustion chamber means, (d) extending a downhole fuel supply conduit to the open upper end of the elongated combustion chamber means internally of the air inlet cylinder for forming an air inlet annulus around the fuel supply conduit, (e) extending a tubing around the air inlet cylinder and connecting the tubing to the combustion chamber means for forming a downhole air supply annulus for the combustion chamber means, (f) forming a secondary air supply annulus between the tubing and the well casing for supplying heat to the reservoir, (g) mounting at least one thermocouple in the combustion chamber means adjacent the ignitor for detecting whether an air-fuel mixture in the combustion chamber means is ignited or not ignited, and (h) interconnecting power means with both the ignitor and the thermocouple and connecting limit set means (48) to the thermocouple for making the ignitor responsive to the thermocouple when no combustion is occurring for igniting the air-fuel mixture in the combustion chamber means and for de-energizing the ignitor when combustion is occurring in the air-fuel combustion chamber means for providing an automatic reliable, and flameout proof burner for in situ combustion deep in one well.

2. A method for assembling an automatic downhole burner for an in situ combustion operation in a well in a subterranean reservoir for recovery of petroleum from the well comprising, (a) forming an elongated vertical combustion chamber means open at both ends, having both fuel supply and air supply conduits connected thereto for mixing the air and fuel in the combustion chamber, (b) mounting a thermocouple adjacent an ignitor in the combustion chamber intermediate the ends thereof for detecting whether the air-fuel mixture in the combustion chamber means is ignited or not ignited, and (c) interconnecting power means with both the ignitor and the thermocouple and connecting limit set means (48) to the thermocouple for making the ignitor responsive to the thermocouple for igniting the air-fuel mixture when no combustion is occurring and for de-energizing the ignitor when combustion is occurring for providing an automatic, reliable, and flameout proof burner for in situ combustion deep in the well.

3. A method as recited in claim 2 comprising further, (a) connecting electrical conduits to both the ignitor and the thermocouple, and (b) embedding the electrical conduits in the walls of the air supply conduit and in the walls of the fuel supply conduit.

4. A method as recited in claim 2 comprising the additional step of, (a) forming a plurality of transverse air ducts in the walls of the air supply conduit for passage of air from a downhole air supply annulus to the air-fuel combustion chamber for ensuring a highly agitated combustible mixture.

5. A method as recited in claim 2 comprising further, (a) forming the connection between the air supply conduit and the combustion chamber into a detachable connection for being sealed and unsealed.

6. A method for assembling an automatic downhole burner for an in situ combustion operation in a well in a subterranean reservoir for recovering petroleum from the well comprising, (a) forming an elongated combustion chamber means open at both ends with an ignitor means therein, (b) forming orifices in the walls of an air inlet cylinder connected to the upper end of the combustion chamber means, (c) extending a downhole fuel supply conduit (24) to the open upper end of the elongated combustion chamber means internally of the air inlet cylinder (19) for forming an air inlet annulus around the fuel supply conduit, (d) extending a tubing (13) around the the air inlet cylinder and connecting the tubing to the combustion chamber means for forming a downhole air supply annulus for the combustion chamber means, (e) mounting at least one thermocouple means in the combustion chamber means adjacent the ignitor for detecting whether an air-fuel mixture in the combustion chamber means is ignited or not ignited, (f) mounting an electrical conduit means on the walls of both the fuel supply conduit and the air inlet cylinder for energizing both the thermocouple means and the ignitor means, and (g) interconnecting power means with both the ignitor and the thermocouple and connecting limit set means (48) to the thermocouple for making the ignitor responsive to the thermocouple when no combustion is occurring for igniting the air-fuel mixture in the combustion chamber means and for de-energizing the ignitor when combustion is occurring in the air-fuel combustion chamber means for providing an automatic reliable, and flameout proof burner for in situ combustion deep in the well.

7. A method for assembling an automatic downhole burner for an in situ combustion operation in a well in a subterranean reservoir for recovery of petroleum from the well comprising, (a) forming an elongated vertical combustion chamber means open at both ends, having both fuel supply and air supply conduits connected thereto for mixing the air and fuel in the combustion chamber, (b) mounting a thermocouple adjacent an ignitor in the combustion chamber intermediate the ends thereof for detecting whether the air-fuel mixture in the combustion chamber means is ignited or not ignited, (c) mounting an electrical conduit means on the walls of both the fuel supply conduit and the air supply conduit for energizing both the thermocouple and the ignitor, and (g) interconnecting power means with both the ignitor and the thermocouple and connecting limit set means (48) to the thermocouple for making the ignitor responsive to the thermocouple for igniting the air-fuel mixture when no combustion is occurring and for de-energizing the ignitor when combustion is occurring for providing an automatic, reliable, and flameout proof burner for in situ combustion deep in the well.

8. A method for assembling an automatic downhole burner for an in situ combustion operation in a well in a subterranean reservoir for recovery of petroleum from the well comprising, (a) forming an elongated vertical combustion chamber means open at both ends having both fuel supply and air supply conduits connected thereto for mixing the air and fuel in the combustion chamber and for passing additional air around the combustion chamber (14), (b) mounting a thermocouple (31, FIG. 4) to the upper portion of the elongated vertical combustion chamber (14) for detecting overheating of the combustion chamber upper portion, (c) electrically connecting said thermocouple (31) to a limit set means (56), and (d) forming said limit-set means (56) responsive to said thermocouple (31) for causing the flow of additional air around said combustion chamber means when detecting overheating of said combustion chamber means upper portion.

* * * * *